US008505466B2

(12) United States Patent
Rekasch

(10) Patent No.: US 8,505,466 B2
(45) Date of Patent: Aug. 13, 2013

(54) RAIL VEHICLE HAVING A DETACHABLY ATTACHED HOUSING LID

(75) Inventor: Klaus Rekasch, Rheurdt (DE)

(73) Assignee: Siemens Aktiengesellschaft, München (DE)

( * ) Notice: Subject to any disclaimer, the term of this patent is extended or adjusted under 35 U.S.C. 154(b) by 121 days.

(21) Appl. No.: 13/028,285

(22) Filed: Feb. 16, 2011

(65) Prior Publication Data

US 2012/0205380 A1 Aug. 16, 2012

(51) Int. Cl.
*B61D 39/00* (2006.01)
*B65D 45/20* (2006.01)

(52) U.S. Cl.
USPC ..... 105/377.11; 220/324

(58) Field of Classification Search
USPC ..... 220/324, 315, 326, 200; 292/281; 105/404, 355, 377.11, 377.01
IPC . B65D 45/20, 45/16; B61D 39/00; E05C 19/08
See application file for complete search history.

(56) References Cited

U.S. PATENT DOCUMENTS

| | | | | | |
|---|---|---|---|---|---|
| 985,016 | A | * | 2/1911 | Donnell | 220/324 |
| 1,773,693 | A | * | 8/1930 | Stirrup | 292/113 |
| 1,802,214 | A | * | 4/1931 | Miller | 292/281 |
| 1,994,150 | A | * | 3/1935 | Stewart | 105/355 |
| 2,134,314 | A | * | 10/1938 | O'Donnell | 292/115 |
| 2,204,164 | A | * | 6/1940 | Steuber | 454/89 |
| 3,471,054 | A | * | 10/1969 | Ostrowsky et al. | 220/318 |
| 5,385,257 | A | * | 1/1995 | Hung | 220/324 |
| 5,706,968 | A | * | 1/1998 | Riley | 220/326 |
| 6,050,441 | A | * | 4/2000 | Kuo | 220/324 |

FOREIGN PATENT DOCUMENTS

| | | | |
|---|---|---|---|
| DE | 102009006637 | A1 | 8/2010 |
| EP | 0599031 | A1 | 6/1994 |

* cited by examiner

*Primary Examiner* — Robert J Hicks

(57) ABSTRACT

A rail vehicle having an equipment housing is provided. A housing lid is detachably attached to a housing base body of the equipment housing. The housing lid is respectively fastened to two opposite sides of the housing by fasteners on the housing base body. The fasteners are each fastened to the housing base body by hinges which are secured at an end by one of their limbs to the housing base body and the fasteners are rotatably mounted at the end on their other limb. A hinge axis and a bearing axis for the fasteners are oriented essentially parallel to one another.

10 Claims, 2 Drawing Sheets

RAIL VEHICLE HAVING A DETACHABLY ATTACHED HOUSING LID

FIELD OF INVENTION

The invention relates to a rail vehicle having an equipment housing which is equipped with a housing lid which is detachably attached to a housing base body.

SUMMARY OF INVENTION

Equipment housings which serve to accommodate various components are mainly accommodated in the roof region of rail vehicles. For example, an air-conditioning system housing is frequently accommodated in this roof region and equipped with a housing lid which is detachably attached to a housing base body.

These housing lids have previously been fastened to the housing base body on one side by means of hinges and on the opposite side by means of detachable closures. This has the disadvantage that accessibility to the housing for servicing purposes is restricted after the housing lid is opened.

An object of the claimed invention is to provide a rail vehicle, wherein accessibility to the interior of the equipment housing for servicing purposes is improved.

This object is achieved in that the housing lid is respectively fastened to two opposite sides of the housing by means of at least one fastener on the housing base body, wherein the fasteners are each fastened to the housing base body by means of hinges which are secured at the end by one of their limbs to the housing base body and the fastener is rotatably mounted at the end on their other limb, wherein in addition a hinge axis and a bearing axis for the fastener are oriented essentially parallel to one another.

As a result of the two-sidedness of the fasteners which are provided it is possible to completely lift off the housing lid from the housing base body, facilitating increased accessibility for servicing purposes. The particular type of coupling of the fasteners to the housing base body ensures easy release and attachment of the housing lid to the housing base body.

The fasteners preferably each have a fastening hook which is designed to interact with an exposed closing angular bracket, which is secured opposite an underside of the housing lid. It is to be emphasized that the closing angular bracket can also be fastened directly to the underside of the housing lid. However, it is advantageous if the exposed closing angular bracket is attached to a holding element, which is in turn secured to the underside of the housing lid. This holding element penults the housing lids to be conveniently set down on associated supports on the housing base body.

The hinges are preferably embodied in such a way that they have, as the limb attached to the housing base body, a roller support, and, as the freely moving limb, an arm whose one end is mounted on the roller support so as to be rotatable about the hinge axis, and whose other end bears the fastener via a bearing block.

In this context, the bearing region for the atm of the respective hinge can be designed to interact with the abovementioned holding element on the housing lid.

BRIEF DESCRIPTION OF THE DRAWINGS

An exemplary embodiment of the invention will be explained in more detail below with reference to the drawings, in which.

DETAILED DESCRIPTION OF INVENTION

Figure 1:
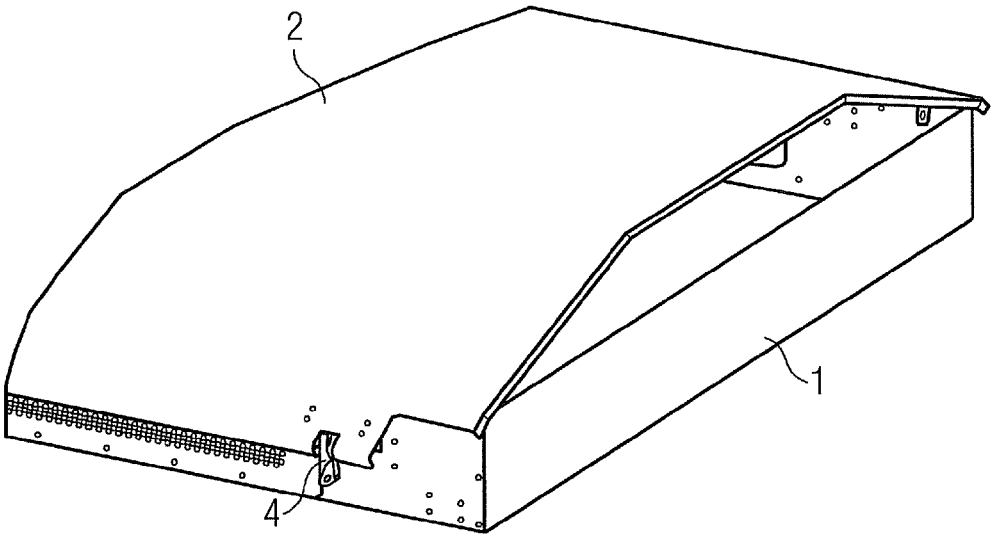
FIG. 1 shows a perspective view of an equipment housing.
Figure 2:
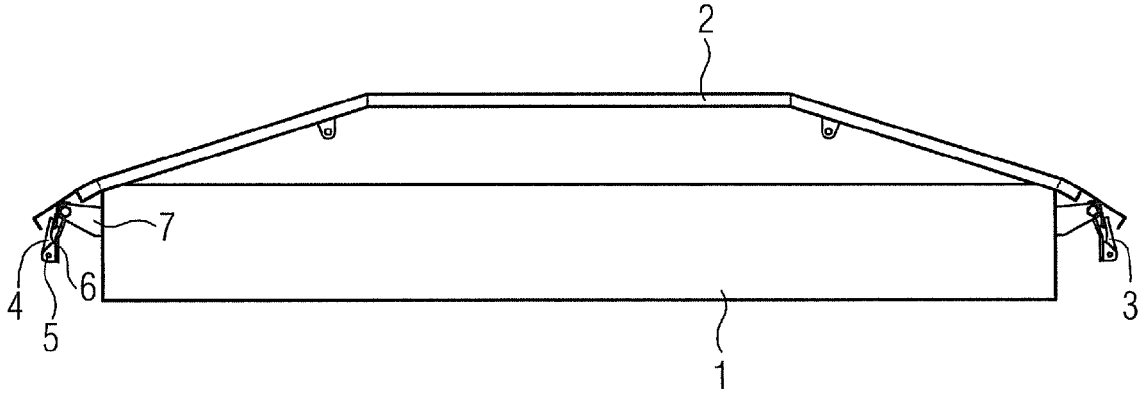
FIG. 2 shows a side view of the equipment housing from FIG. 1.

The equipment housing FIGS. 1 and 2 can serve, for example, to accommodate an air-conditioning system and is typically accommodated in the roof region of a rail vehicle. The equipment housing has to be opened for servicing purposes. For this reason, the equipment housing is composed of a housing base body 1 and a housing lid 2. The housing base body 1 and the housing lid 2 are connected to one another via two fasteners 3, 4 lying opposite one another. As is apparent in particular from FIG. 1, the housing lid 2 has corresponding cutouts for releasing the fasteners 3, 4.

The fasteners 3, 4 can be released so that the housing lid 2 can be removed completely from the housing base body 1. This provides very favorable accessibility, for example for maintenance purposes, to the housing base body or to the component accommodated therein.

Figure 3:
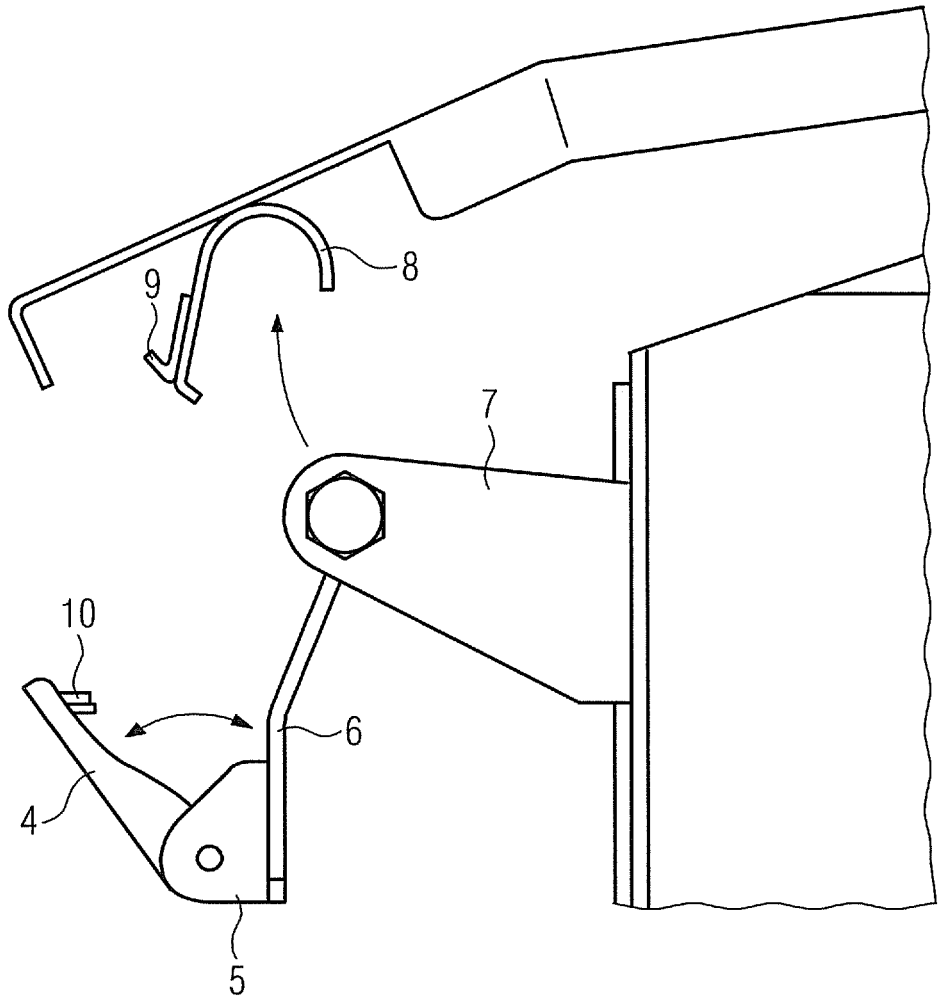
FIG. 3 shows a view of a detail of the equipment housing from FIG. 1 with a released fastener.

FIG. 3 shows in a view of a detail the more detailed embodiment of the coupling of the fastener 4 to the housing base body 1, and the embodiment of the housing lid region which is attached to the housing base body 1 using the fastener 4.

The fastener 4 is rotatably mounted on a bearing block 5, which is in turn attached to an arm 6. The arm 6 forms, together with a roller support 7, a hinge. In this context, the arm 6 ends at the roller support end in a sleeve (not illustrated) which can be rotated on a roller (not illustrated either). The bearing means for the fastener 4 therefore has two rotational axes, one of which is defined by the hinge composed of the arm 6 and the roller support 7, and the other by the bearing means of the fastener 4 on the bearing block 5.

On the housing lid side, a holding element 8 is provided which, when the housing lid 2 is lowered, engages on the roller support 7 via the roller (not illustrated), so that a suitable support of the housing lid 2 is provided in a locked position of the fastener 4. The holding element 8 bears an exposed closing angular bracket 9, which is provided to interact with a fastening hook 10 on the fastener 4.

The illustrated detachable attachment of the housing lid 2 to the housing base body 1 permits increased maintenance comfort. In particular, in the case of the maintenance of roof-mounted air-conditioning systems it is not necessary to ensure that the rail vehicle in question is stationary with respect to a working platform.

There is also potential for savings owing to shorter maintenance times. If, for example, the housing lid 2 is damaged, it can easily be replaced. In terms of weatherproofness, the closure concept presented here is also beneficial for the housing lid 2 of an equipment housing.

The invention claimed is:

1. A rail vehicle, comprising:

an equipment housing accommodated in a roof region of a rail vehicle;

a housing lid which is detachably attached to a housing base body of the equipment housing; and fasteners, wherein the housing lid is respectively fastened to two opposite sides of the housing by the fasteners, wherein the fasteners are each fastened to the housing base body by hinges which are secured at an end by one of their limbs to the housing base body, wherein the fasteners are rotatably mounted at the end on their other limb, wherein a hinge axis and a bearing axis for each fastener are oriented essentially parallel to one another, and wherein the housing lid has cutouts for releasing the fasteners.

2. The rail vehicle as claimed in claim 1, wherein the fasteners each include a fastening hook which is designed to interact with an exposed closing angular bracket secured opposite an underside of the housing lid.

3. The rail vehicle as claimed in claim 2, wherein the exposed closing angular bracket is secured to the underside of the housing lid via a holding element.

4. The rail vehicle as claimed in claim 1, wherein the hinges include, in each case as the limb attached to the housing base body, a roller support, and, as the freely moving limb, an arm whose one end is mounted on the roller support so as to be rotatable about the hinge axis, and whose other end bears the fastener via a bearing block.

5. The rail vehicle as claimed in claim 2, wherein the hinges include, in each case as the limb attached to the housing base body, a roller support, and, as the freely moving limb, an arm whose one end is mounted on the roller support so as to be rotatable about the hinge axis, and whose other end bears the fastener via a bearing block.

6. The rail vehicle as claimed in claim 3, wherein the hinges include, in each case as the limb attached to the housing base body, a roller support, and, as the freely moving limb, an arm whose one end is mounted on the roller support so as to be rotatable about the hinge axis, and whose other end bears the fastener via a bearing block.

7. The rail vehicle as claimed in claim 1, wherein a respective bearing region of the hinges serves as a support for the housing lid.

8. The rail vehicle as claimed in claim 2, wherein a respective bearing region of the hinges serves as a support for the housing lid.

9. The rail vehicle as claimed in claim 3, wherein a respective bearing region of the hinges serves as a support for the housing lid.

10. The rail vehicle as claimed in claim 4, wherein a respective bearing region of the hinges serves as a support for the housing lid.

* * * * *